United States Patent [19]

Tsukamoto et al.

[11] 3,981,268

[45] Sept. 21, 1976

[54] DEVICE FOR CONTROLLING ELECTRIC POTENTIAL APPLIED TO DEVELOPING ELECTRODE IN AN ELECTROPHOTOGRAPHIC DUPLICATOR

[75] Inventors: Takuzo Tsukamoto; Mitsuharu Nakaguchi; Hidetoshi Kito; Toshio Nagashima; Akihiko Shirata; Shinichi Tsuda, all of Ebina, Japan

[73] Assignee: Fuji Xerox Co., Ltd., Tokyo, Japan

[22] Filed: June 11, 1975

[21] Appl. No.: 585,780

[52] U.S. Cl. ..... 118/8; 118/637; 427/8

[51] Int. Cl.[2] ..... G03G 15/08

[58] Field of Search ..... 118/637, 8; 427/18, 427/20, 8; 355/3 DD

[56] References Cited

UNITED STATES PATENTS

| | | | |
|---|---|---|---|
| 3,654,893 | 4/1972 | Piper et al. | 118/8 |
| 3,674,532 | 7/1972 | Morse | 355/3 DD |
| 3,779,204 | 12/1973 | Altmann | 118/637 |
| 3,805,739 | 4/1974 | Feldeisen et al. | 118/637 |
| 3,837,741 | 9/1974 | Spencer | 118/637 |
| 3,877,413 | 4/1975 | Rowell et al. | 118/637 |

*Primary Examiner*—Mervin Stein
*Assistant Examiner*—Douglas Salser
*Attorney, Agent, or Firm*—Gerald J. Ferguson, Jr.; Joseph J. Baker

[57] ABSTRACT

A device for use in an electrophotographic duplicator employing a sensitive member comprising a temperature-dependent sensitive material whose static charge characteristic varies with the surface temperature thereof, the sensitive member bearing an electrostatic latent image having an image region and a background region, the device comprising a developing electrode disposed at the periphery of the sensitive member for effecting uniform development of the image region; temperature sensitive means disposed in the vicinity of the sensitive member responsive to the surface temperature of the sensitive member for generating a bias potential for the developing electrode, the developing electrode being so controlled by the bias potential that the bias potential is always maintained at a value greater than the value of the potential of the background region even when the temperature at the surface of the sensitive material decreases substantially thereby necessitating a substantial increase in the bias potential whereby little, or any, toner is deposited on the background region to thereby lessen fogging thereof.

4 Claims, 3 Drawing Figures

DEVICE FOR CONTROLLING ELECTRIC POTENTIAL APPLIED TO DEVELOPING ELECTRODE IN AN ELECTROPHOTOGRAPHIC DUPLICATOR

BACKGROUND OF THE INVENTION

1. Field of the Invention

The present invention relates to a bias voltage control device for use in an electrophotographic duplicator employing a temperature-dependent sensitive material (hereinafter referred to as sensitive material) whose static charge characteristic varies with temperature variation, and more particularly to a device capable of automatically changing the bias voltage being applied to a developing electrode in accordance with the temperature variation of the sensitive material.

2. Discussion of the Prior Art.

Generally, with the development with charged toner of a static latent image occurring on a photoconductor or other charged insulating material, a problem, known as white dropout, arises. In particular, the central portions of large-image regions or of thick characters fails to be developed with the toner. This phenomenon results from the electric field of the charged latent image being concentrated at its end portions, the field intensity being low in the center of the image region whereby uniform deposition of toner is difficult. To prevent white dropout, developing electrodes have been used heretofore. Here, the term "developing electrode" is defined to include an electrode plate in a cascade developing unit and a developing roll in a magnetic-brush developing unit.

The developing electrode is disposed in proximity to the region to be developed so as to generate an electric field of uniform intensity over the entire region so that toner is also directed by the developing electrode to the central portions of large-image regions or thick characters, and effect uniform development thereof. Usually the bias potential applied to the developing electrode is higher than the potential of the image background region to prevent deposition of toner onto the background region. Further, the bias potential is sufficiently lower than the potential of the image region.

As described above, it is possible, with a developing electrode, to achieve satisfactory development even of the central portions of large-image regions or thick characters. However, since the bias voltage applied to the developing electrode is usually set to a fixed value, satisfactory development can be expected only when the static charge characteristic of the sensitive material is stable with respect to variations of ambient conditions. If the sensitive material used has a static charge characteristic that varies with ambient conditions, the developing electrode, to which a fixed bias potential is applied, may conversely bring about deterioration of image quality since as stated above, the bias potential should be higher than the background potential. However, if the background potential increases the developing electrode potential, toner will undesirably deposit on the background region.

In FIG. 1, curve 1 graphically represents the relationship between the temperature of a temperature-dependent sensitive material and the potential of the background region on the sensitive material. It is obvious from this graph that the potential of the background region on the sensitive material rises as the sensitive material temperature decreases in accordance with ambient temperature variation. If a large temperature drop occurs, the background region potential increases above the developing electrode potential. As a result, toner is undesirably deposited on the background region to cause conspicuous stain. This phenomenon is generally called "fog". One of the means to eliminate fog is to apply a high bias potential to the developing electrode even under normal ambient conditions, in anticipation of a temperature decrease of the sensitive material and a corresponding potential rise in the background region. However, this decreases the potential difference between the developing electrode and the image region potential. Thus, a high-concentration developer is required for a desired image density. As a result, there is an undesired increase of toner comsumption and machine contamination.

Moreover, the image region potential varies as the number of copies increases. If the image region potential is relatively low as described above, the image potential variation becomes large whereby the image density is liable to change even when a developing agent of the same concentration is used.

SUMMARY OF THE INVENTION

The present invention has been accomplished in view of the above-mentioned circumstances, and its object is to provide, for use in an electrophotographic duplicator employing a temperature-dependent sensitive material, a bias potential control device capable of changing the bias potential, which is applied to a developing electrode, in accordance with the temperature variation of the sensitive material so that a stable copy quality may always be obtained regardless of the temperature variation occurring at the sensitive material.

Other objects and advantages of this invention will be apparent from a reading of the following specification and claims taken with the drawing.

DETAILED DESCRIPTION OF THE PREFERRED EMBODIMENT

Figure 2:
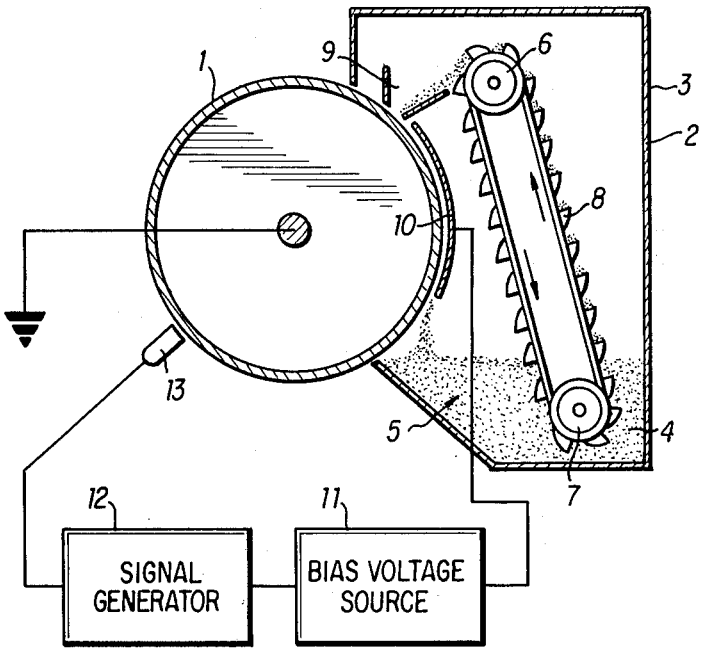
FIG. 2 illustrates an embodiment of the invention adapted for a cascade developing unit.

In FIG. 2, a sensitive drum comprising a temperature-dependent sensitive material, and a cascade developing unit 2 for developing a static latent image formed on the upper surface of the sensitive drum 1 is provided adjacent drum 1. A storage chamber 5 for a developer 4 is formed in the lower portion of a housing 3. The developer 4 stored in chamber 5 is fed into a hopper 9 by means of a bucket conveyor 8 driven between a roller 6 provided diagonally above sensitive drum 1 and a roller 7 provided in the lower portion of storage chamber 5. The hopper 9 is located between roller 6 and sensitive drum 1 and feeds developer 4 into a space formed between the periphery of sensitive drum 1 and a developing electrode 10 disposed along the periphery of sensitive drum 1.

The developing electrode 10 may be approximately the same width as that of sensitive drum 1 and may conventionally consist of several segments (not shown). A controlled bias voltage is applied to developing electrode 10 from the output of a bias voltage source 11. A temperature detector 13 disposed at the periphery of sensitive drum 1 is connected to the input of bias voltage source 11 through a signal generator 12. The temperature detector 13 may be for example, a thermistor and is capable of detecting the temperature on the periphery of sensitive drum 1. The signal obtained from the detector 13 is converted into a control signal by signal generator 12 and then is fed to bias voltage source 11.

Figure 1:
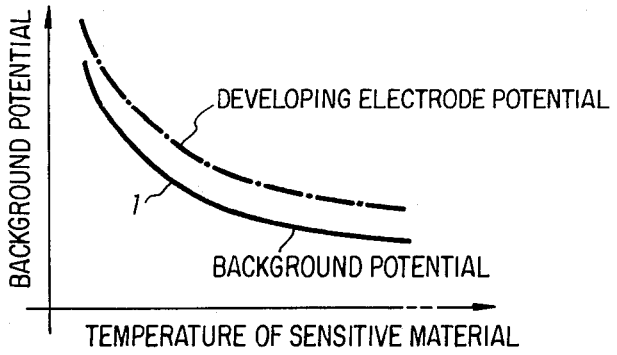
FIG. 1 is a graphic representation of the relationship between the temperature of a sensitive material and the background potential of a developing electrode.

In developing a static latent image on the surface of sensitive drum 1, a bias voltage or potential is applied to developing electrode 10 in accordance with the peripheral temperature of sensitive drum 1, so that the potential of developing electrode 10 is continuously controlled to always be higher than the potential of the background region where the broken line of FIG. 1 corresponds to the developing electrode potential. Thus, the toner in the developer 4 being fed into the space between sensitive drum 1 and developing electrode 10 by bucket conveyor 8 is not deposited onto the background region and yet developing electrode 10 insures the deposition of toner onto the central portions of large-image regions or thick characters.

Figure 3:
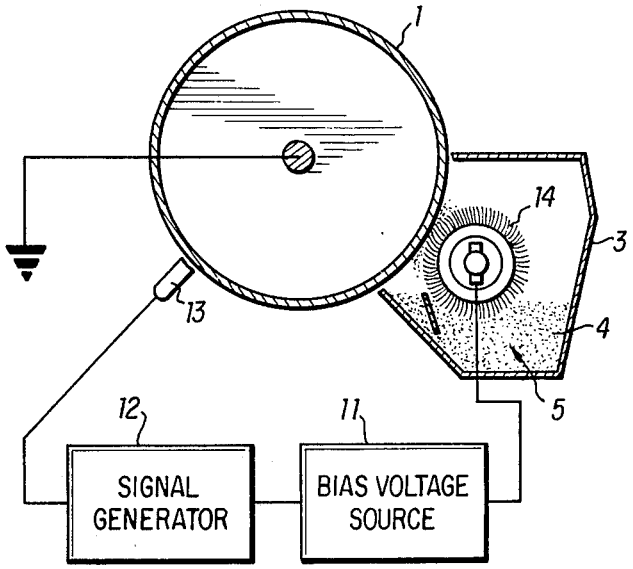
FIG. 3 illustrates an embodiment of the invention adapted for a magnetic-brush developing unit.

The above description is directed to a cascade developing unit embodiment. In the case of a magnetic-brush developing unit as illustrated in FIG. 3, the same effect can be achieved by applying the output from bias voltage source 11 to a cylindrical developing electrode 10 of a magnetic-brush 14 disposed in a housing 3 and continuously controlling the potential of developing electrode 10 to always be higher than that of the background region. In both of the above embodiments, the output from bias voltage source 11 is continuously changed and applied to developing electrode 10. However, it is, of course, possible to discontinuously change the bias voltage, if desired.

As described in detail hereinabove, the present invention is capable of controlling the developing electrode potential to always be higher than the background region potential by applying a bias voltage to the developing electrode in accordance with the temperature variation occurring on the sensitive material, so that even when the temperature on the periphery of the sensitive material has substantially decreased due to ambient temperature fluctuation, the developing electrode potential is always maintained above the background region potential, thereby preventing fog caused by deposition of toner onto the background region. Thus, a clear copy is consistently obtained regardless of temperature variations of the sensitive material, and, in particular, a white dropout in large-image regions or thick characters is prevented by means of the developing electrode of this invention.

What is claimed is:

1. A device for use in an electrophotographic duplicator employing a sensitive member comprising a temperature-dependent sensitive material whose static charge characteristic varies with the surface temperature thereof, said sensitive member bearing an electrostatic latent image having an image region and a background region, said device comprising a developing electrode disposed at the periphery of said sensitive member for effecting uniform development of said image region;

temperature sensitive means disposed in the vicinity of said sensitive member responsive to said surface temperature of the sensitive member for generating a bias potential for said developing electrode, said developing electrode being so controlled by said bias potential that said bias potential is always maintained at a value greater than the value of the potential of said background region even when the temperature at the surface of said sensitive material decreases substantially thereby necessitating a substantial increase in the bias potential whereby little, if any, toner is deposited on said background region to thereby lessen fogging thereof.

2. A device as in claim 1 where said temperature sensitive means includes means for detecting said surface temperature and generating a temperature signal and means for converting said temperature signal to said bias potential.

3. A device as in claim 1 where said developing electrode includes an electrode plate in a cascade developing unit.

4. A device as in claim 1 where said developing electrode includes a developing roll in a magnetic-brush developing unit.

* * * * *